United States Patent [19]

Spies

[11] 4,249,837

[45] Feb. 10, 1981

[54] METHOD OF AND APPARATUS FOR SUPPORTING AN OVERBURDEN

[75] Inventor: Klaus Spies, Dortmund, Fed. Rep. of Germany

[73] Assignee: Heintzman GmbH & Co., Bochum, Fed. Rep. of Germany

[21] Appl. No.: 957,355

[22] Filed: Nov. 3, 1978

Related U.S. Application Data

[63] Continuation-in-part of Ser. No. 850,096, Nov. 8, 1977.

[51] Int. Cl.[3] ..... E21D 15/18; E21D 15/22

[52] U.S. Cl. ..... 405/290; 248/356

[58] Field of Search ..... 405/288, 290, 229, 239; 248/354 R, 357 H, 356; 52/744, 632

[56] References Cited

U.S. PATENT DOCUMENTS

| | | | |
|---|---|---|---|
| 1,752,101 | 3/1930 | Meutsch | 248/356 |
| 1,821,020 | 9/1931 | Mensforth | 248/356 |
| 2,322,855 | 6/1943 | Lenahan | 405/230 |
| 2,451,777 | 10/1948 | Salas | 405/230 |
| 2,753,036 | 7/1956 | Joy | 248/356 X |
| 2,890,854 | 6/1959 | Vogel | 248/356 |
| 3,292,892 | 12/1966 | Abbott | 248/354 R |
| 3,594,973 | 7/1971 | Archer | 52/632 X |
| 3,690,110 | 9/1972 | Wiswell | 405/216 |

FOREIGN PATENT DOCUMENTS

| | | | |
|---|---|---|---|
| 271518 | 4/1965 | Australia | 248/356 |
| 740972 | 11/1943 | Fed. Rep. of Germany | 248/356 |
| 920483 | 3/1955 | Fed. Rep. of Germany | 248/356 |
| 1483943 | 10/1969 | Fed. Rep. of Germany | 248/356 |
| 712661 | 10/1931 | France | 248/356 |
| 212189 | 4/1967 | Sweden | 405/230 |
| 407518 | 8/1966 | Switzerland | 248/356 |
| 232990 | 11/1925 | United Kingdom | 248/356 |
| 653223 | 5/1951 | United Kingdom | 405/239 |
| 770305 | 3/1957 | United Kingdom | 248/356 |
| 966592 | 8/1964 | United Kingdom | 248/356 |
| 1016292 | 1/1966 | United Kingdom | 248/356 |

*Primary Examiner*—Dennis L. Taylor

*Attorney, Agent, or Firm*—Michael J. Striker

[57] ABSTRACT

A method and an arrangement are disclosed for supporting a roof of an underground excavation. A hollow prop casing of two or more telescopable sections is erected and telescoped apart until it bears on the floor and the roof. The sections are then biased against the floor and the roof and the prop casing is filled with a hardenable substance which upon hardening forms in the casing a solid column capable of supporting the roof.

56 Claims, 20 Drawing Figures

FIG. 3
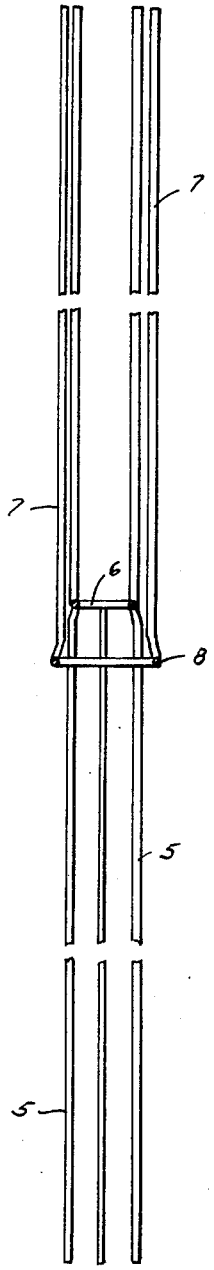
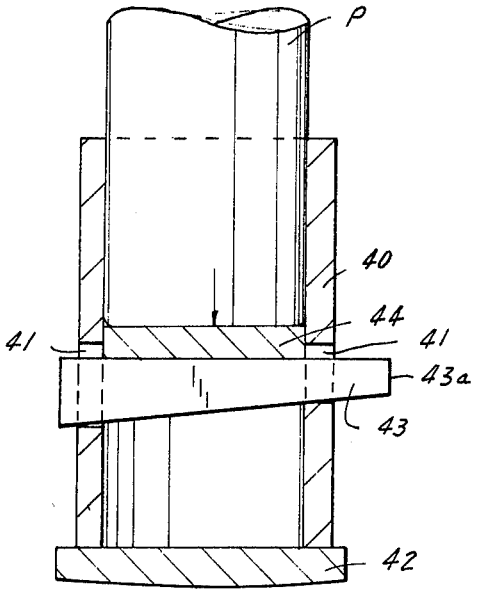
FIG. 8
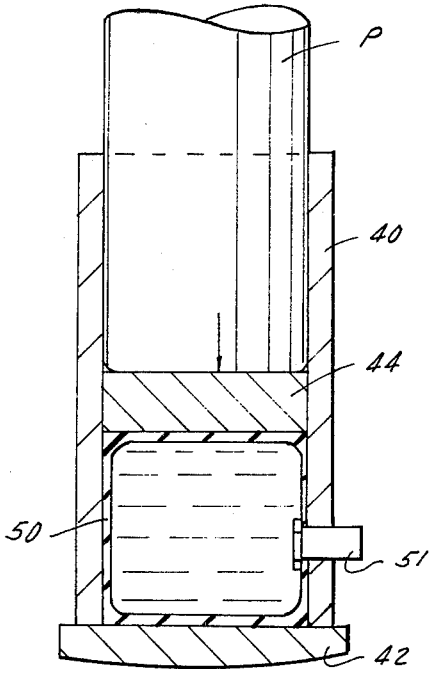
FIG. 9

METHOD OF AND APPARATUS FOR SUPPORTING AN OVERBURDEN

BACKGROUND OF THE INVENTION

This is a continuation-in-part of copending application Ser. No. 850,096, filed Nov. 8, 1977.

FIELD OF THE INVENTION

The present invention is directed to a method of supporting an overburden, for example the roof of an underground excavation.

The invention is also directed to apparatus for carrying out the method.

THE PRIOR ART

In many instances it is necessary to support an overburden against collapse. This is particularly true in the field of underground excavations, for example in the construction of mining galleries, tunnels, and the like, where the roof must be supported to prevent cave-in. Various approaches for effecting such support are known from the prior art. In mining, particularly in the mining of coal, it is known to use the "room and pillar system" in which steel rods or bars are installed and anchored in the strata of the overburden, to hold them together and prevent collapse. Also known are different types of supporting structures of wood and/or steel, wherein rigid or only slightly yieldable supporting elements are used to support the roof from below against collapse.

This latter type of approach, to which the present invention is also directed, is generally satisfactory. However, the prior-art proposals all suffer from the disadvantage that they are relatively complicated and expensive, and also that the supports are difficult to erect and to remove. The support elements are relatively expensive which is an important consideration since they are required in large numbers. Also, they are heavy and difficult to handle which presents a particular problem in the confined environments found in underground excavations.

SUMMARY OF THE INVENTION

It is, therefore, a general object of the present invention to overcome the disadvantages of the prior art.

A more particular object is to provide an improved method of supporting an overburden, especially the roof of an underground excavation.

Another object is to provide such a method which facilitates the erection and removal of roof supports and which reduces the attendant costs.

A further object is to provide an improved system or arrangement for supporting an overburden, particularly a roof of an underground excavation such as a mine.

A concomitant object is the provision of such a system which is simpler than those known from the prior art, is much less expensive and is much ligher in weight and therefore easier to handle in all types of environments.

Still a further object is to provide a system of the kind under discussion which utilizes support elements that are inexpensive and light in weight so that they can be readily moved and installed.

Yet another object is to provide special means for protecting the support elements against damage due to overloading.

It is also an object of the invention to provide means for enabling the removal of support elements, even though the elements are under load.

Pursuant to these objects, and to still others which become apparent as the description proceeds, one aspect of the invention resides in a method of supporting an overburden, particularly the roof of an underground excavation, such as a mine. Briefly stated, the method may comprise the steps of providing a hollow prop casing composed of at least two telescopable sections, erecting the prop casing and telescoping it apart until it bears upon the floor and upon the roof to be supported, biasing the sections of the prop casing in the telescoped-apart position against the floor and the roof, respectively, and filling the prop casing with a hardenable substance in flowable condition so that the substance, upon hardening thereof, forms a solid column which by itself is able to support the roof.

An arrangement (i.e. system) for supporting an overburden may comprise a hollow prop casing composed of at least two telescopable sections which can be telescoped apart subsequent to erection of the prop casing so as to bear upon the roof and a floor beneath the same, the sections having sufficient strength to be self-supporting but not to support the roof, means for biasing the sections in their telescoped-apart condition against the floor and the roof, respectively, and means for filling the prop casing with a hardenable substance in flowable condition so that the substance, upon hardening thereof, forms a solid column which by itself is able to support the roof.

A most important aspect of the invention resides in the fact that the novel prop casing has no roof-supporting function at all. It serves merely as a receptacle (in effect as a casting form) for the hardenable substance while the same is still in flowable form. The actual supporting function is performed by the hardenable substance per se, when the same has hardened and forms a solid supporting column within the casing. This makes it possible to produce the prop casing of very inexpensive materials which are extremely light in weight. For example, synthetic plastic materials such as polyvinylchloride or polyethylene may be used and need only have a thickness which is sufficient to contain the weight of hardenable substance filled into the prop casing, for the period until the substance solidifies. Even rather thin and very inexpensive cardboard has been found to be suitable for the purposes of the invention, provided only that its inner surface—which comes in contact with the still flowable hardenable material—should preferably be coated (e.g. with a foil or layer of such synthetic plastic material as polyvinylchloride or polyethylene, or in fact any other suitable substance) to prevent the cardboard from disintegrating while the filler substance is still in flowable state.

Another aspect which contributes to the drastically reduced cost of the present invention is the fact that the filler substance itself can also be an inexpensive material. It may be a concrete slurry, i.e. a mixture of water and a quick-binding cement, preferably in form of cement powder. Aggregate is preferably added (it may already be accommodated in the prop casing before the slurry is admitted into the same) to further increase the strength of the column being formed. In lieu of, or in addition to the aggregate, the prop casing may also contain at least some of the cement powder which is ultimately required to make the slurry. Other materials are also suitable for the hardenable substance, for example gypsum which again is preferably reinforced with aggregate, or a two-component adhesive system of synthetic plastic material which, when the two components are admixed with one another, will harden and form the requisite solid column. Here, again, it is preferable if aggregate is employed in addition, to become embedded in the two-component system so as to further reinforce the same. The aggregate can be in form of gravel or the like as is known from the construction industry. If gypsum is used, some or all of the gypsum powder required to form the solid column may already be contained in the hollow prop casing before water is admitted into the same, and if a two-component adhesive system is used one of the two components may already be wholly or in part accommodated in the hollow prop casing before the other component is admitted into the same. The aggregate may be admitted from outside during admission of the other component, or of the water, but preferably will already be present in the interior of the prop casing at this time.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a side view of the telescopable reinforcing structure used in the embodiment of FIG. 1;

FIG. 8 is a somewhat diagrammatic vertical section through a pit prop socket which permits the removal of the installed pit prop even when the same is under load;

FIG. 9 is a view analogous to FIG. 8 but illustrating a different embodiment of a pit prop socket;

DESCRIPTION OF THE PREFERRED EMBODIMENTS

Figure 1:
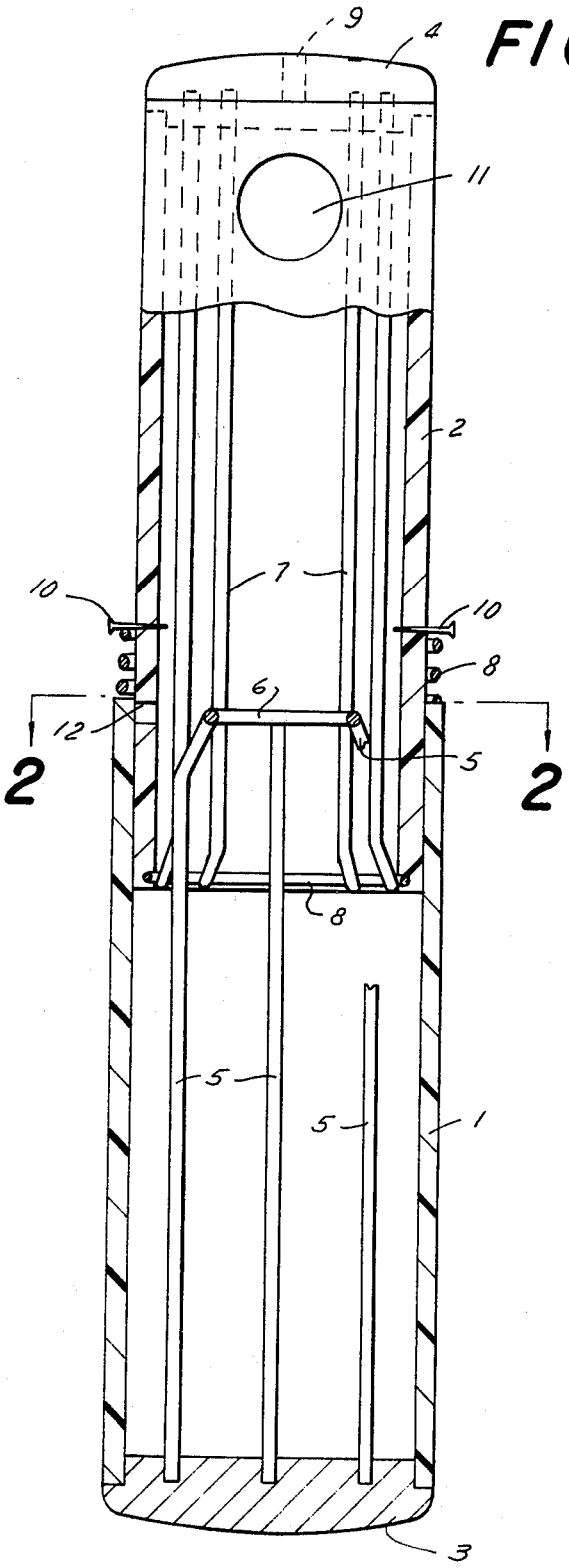
FIG. 1 is a vertical section through a pit prop casing according to the invention.
Figure 2:
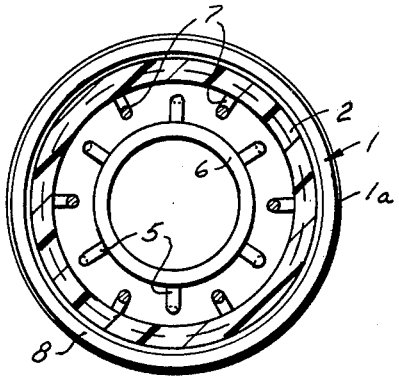
FIG. 2 is a section taken on line II—II of FIG. 1.

An exemplary embodiment of a pit prop casing according to the invention is illustrated in FIGS. 1–3.

The casing is composed of a light-weight, thin-walled outer tubular section 1 of e.g. cardboard and a similar inner tubular section 2 which is telescopable relative to the section 1. The ends of the sections 1, 2 are closed by end caps 3 and 4, respectively, which may be of a different material (e.g. metal, wood, synthetic plastic) and are suitably secured to the respective sections, as by e.g. adhesive bonding or any other suitable manner.

To further increase the strength and durability—not of the prop casing but of the solid support column which will be formed within it when the hardenable material admitted into the casing hardens—a reinforcing arrangement may be provided in the casing 1, 2 which is analogous to the type of arrangements used in reinforced concrete. Such an arrangement must, of course, also be telescopable to accommodate itself to changes in the length (height) of the prop casing as the sections 1, 2 of the same are telescoped apart or together. The reinforcing arrangement can be in form of steel wire mesh or the like. In the embodiment illustrated in FIGS. 1–3 it is in form of two telescopable "baskets" that are arranged in the sections 1, 2, respectively. The inner basket is composed of an annulus of steel rods or bars 5 which are connected at one end (e.g. by welding) to a ring 6. Their other ends may be connected to a similar ring or, as illustrated, they may be secured to (e.g. embedded in) the end cap 3. The outer basket in section 2 is similarly constructed of an annulus of steel rods or bars 7; the diameter of this annulus is greater than that of the annulus of rods 5 and the free ends of rods 7 are connected to a correspondingly larger ring 8. Their other ends may be secured to (e.g. embedded in) the end cap 4 as shown, or they may be connected to another ring. The basket composed of rods 5 and ring 6 is then telescopically guided in the basket composed of rods 7 and ring 8; of course, this relationship may be reversed. The ring 8 is advantageously secured at the free end of the section 2, e.g. adhesively or by having portions projecting into recesses of the wall of section 2 or in any other suitable manner.

Section 2 is exteriorly surrounded by a helical expansion spring 8 (a different type of spring could also be used). Section 2 is provided, preferably in the end cap 4, with a vent hole 9 to permit the escape of air from the interior of the prop casing as hardenable substance is admitted into the same.

When the prop casing is to be used, it is placed in upright position and the section 2 is telescoped out of the section 1 until its end cap 4 bears upon the roof to be supported whereas the end cap 3 bears upon the floor (of course, contact with the floor and/or roof may be direct or some other element may be interposed, as dictated by the requirements of a particular situation). To assure that the casing 1, 2 will be self-retaining in this position, i.e. will press against roof and floor and need not be held by a worker, the spring 8 is now compressed towards the upper edge face 1*a* of the section 1, on which it rests. The degree of compression, and hence the degree of force with which the sections 1, 2 are pressed against the floor and roof as the spring 8 tends to expand again, is selectable and when the selected degree of compression is reached it is fixed by inserting retainers 10 above the spring 8 into the wall of section 2. While it would be possible to provide this wall with several axial spaced annuli of holes and with plugs for closing the holes which are not needed for insertion of the retainers 10, FIGS. 1–3 show a still simpler possibility, namely, the retainers 10 may be in form of pointed spikes or the like which are simply hammered into the wall of section 2. This is possible because the material of section 2 permits such hammering-in very readily; on the other hand, tearing-out of the spikes 10 from the wall under the force of spring 8 is not to be feared because the spring 8 need not be very strong, due to the very light overall weight of the prop casing. Thereafter, the hardenable substance in flowable state (e.g. one of the earlier mentioned substances) is admitted into the prop casing via a port 11 until the interior of the prop casing is completely filled with the substance. As has been mentioned before, aggregate and/or some or all of one of the two components making up the hardenable substance (e.g. cement powder and water; water and gypsum powder; two-component synthetic plastic material) may already be present in the interior of the casing before filling is commenced via the port 11, or may be admitted through this port before the other component or components are admitted. The presence of vent 9 assures that air can escape from the casing during the filling operation, so as not to interfere with the hardening of the substance and its formation of a solid column of proper density. Of course, the material and construction of the prop casing must be such that the hardenable substance can, if necessary, be admitted under a certain amount of pressure to assure proper filling of the casing.

Once the material has hardened it forms a solid column which then constitutes a support or pit prop; i.e. it is this column—reinforced by the bars 5, 7—which supports the overburden. The pit prop casing 1, 2 having served its purpose as a casting form, has no further function and could, if desired, be "peeled off" the support column. However, as a practical matter it will usually remain in place since from an economic point of view it is not worthwhile to make the effort to remove it.

Figure 4:
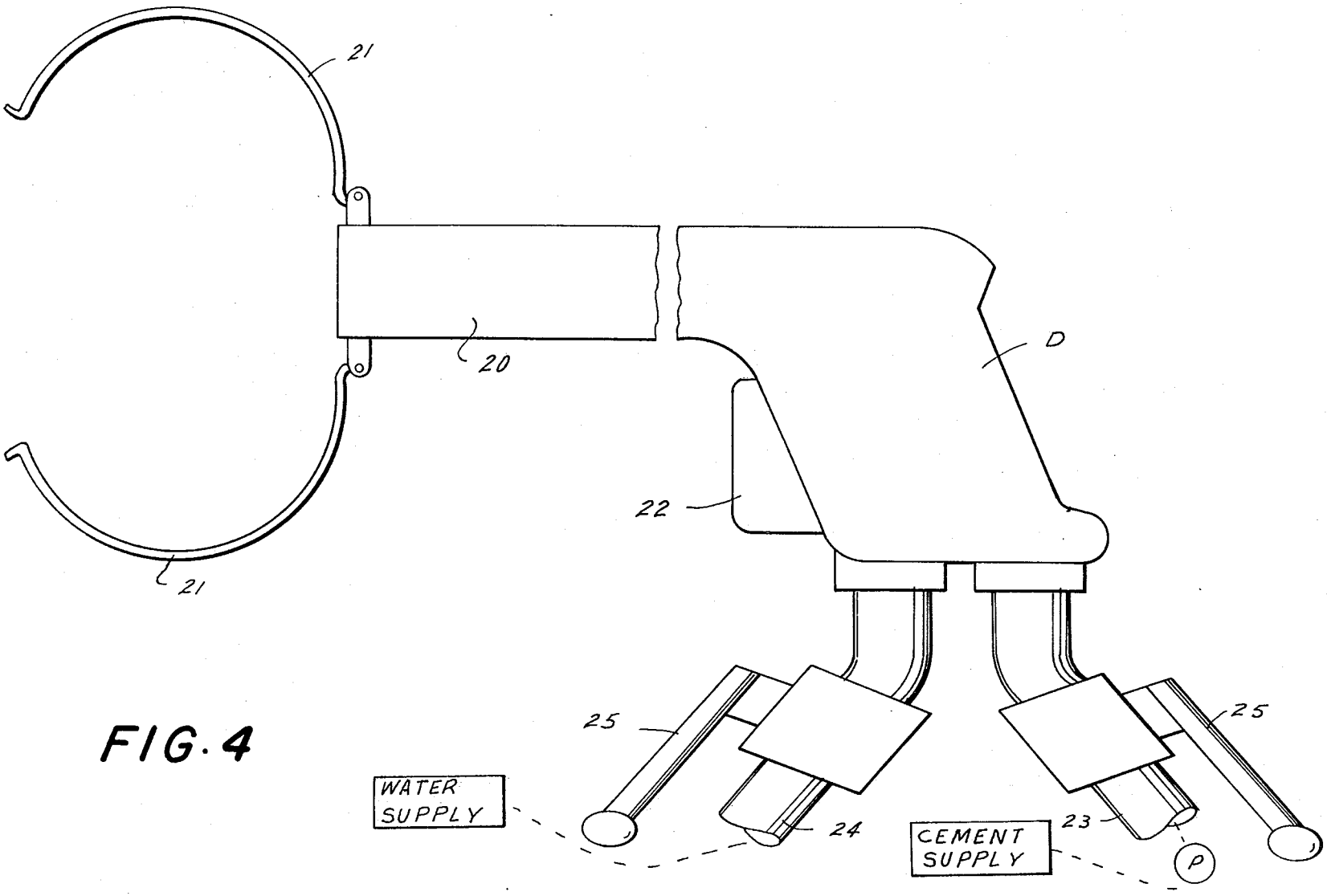
FIG. 4 is a somewhat diagrammatic side view, showing a device for injecting hardenable substance into a prop casing according to the invention, together with the supply elements which cooperate with the device.
Figure 5:
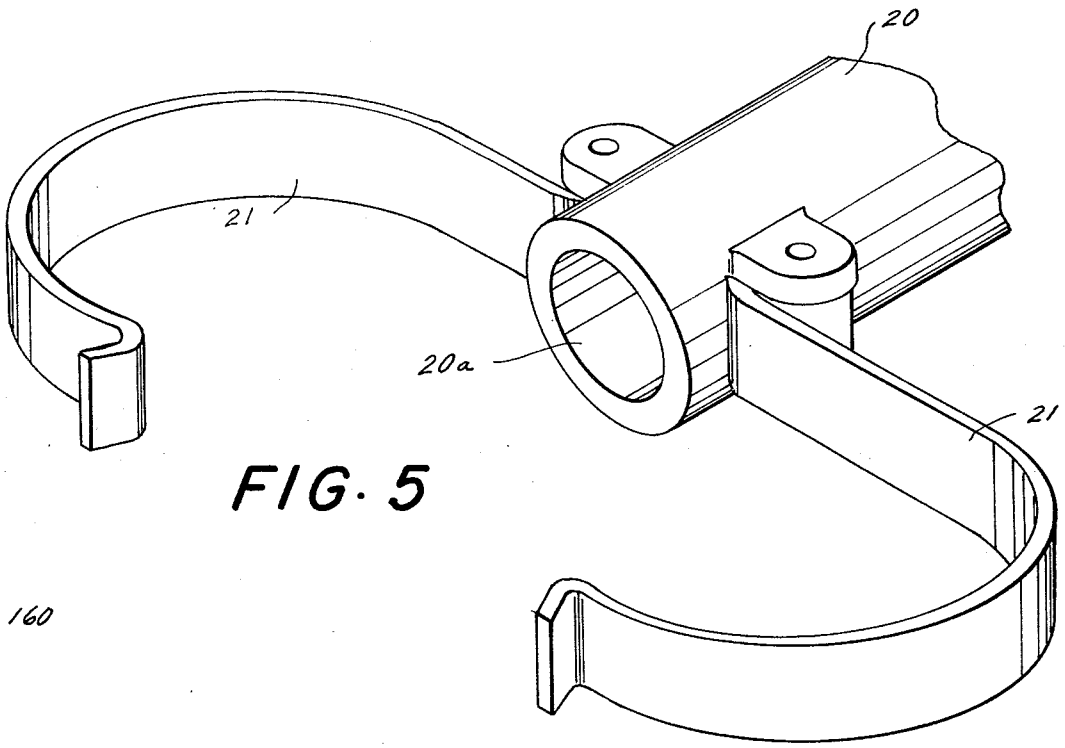
FIG. 5 is a perspective view, showing a detail of FIG. 4 on an enlarged scale.

The admission of the substance through the port 11 is effected by means of an injecting device D which is shown in FIGS. 4 and 5. This injecting device may (but need not be) pistol or gun shaped and have a trigger 22 which, when depressed, permits flow of substance to the outlet opening 20*a* of the device D (FIG. 5) which in use is placed against the port 11. The barrel 20 of the device D is preferably provided with a pair of arms 21 that can pivot apart to the position in FIG. 5 when the device is not in use, but which will pivot to the position illustrated in FIG. 7 in which they embrace the section 2. This will be discussed in more detail later on, in connection with FIG. 7. The port 11 may be provided with a one-way valve (not shown) to permit inflow of the pressurized hardenable substance but to prevent the same from flowing out again through the port 11.

The device D is provided with connections to which a pair of conduits 23 and 24 is secured. The conduit 23 may have a pump P interposed in it which in turn draws e.g. pulverulent cement of the quick-bonding type (known from the construction industry and therefore requiring no detailed discussion) from the diagrammatically illustrated cement supply. The pump P may of course also be supplied with other materials, for example additives which aid in the rapid bonding of the cement, or such additives may be mixed in with the cement powder. The cement powder could be mixed with aggregate, in which case the pump would have to be capable of transporting such aggregate in addition to the cement powder, or a separate pump for the aggregate would have to be provided to supply it to the device D. However, as mentioned before the aggregate may also be placed into the prop casing 1, 2 as or before the same is erected, i.e. placed in upright position to bear against the roof to be supported. The conduit 24 communicates with the diagrammatically illustrated water supply, and a pair of valves 25, 25 are interposed in the respective conduit 23, 24 to permit regulation of the flow of the respective substances into the injecting device D. The mixing of the substances may take place in the device D itself so that a slurry composed of the mixed substances issues from the outlet 20*a* of the device D and enters the port 11. Evidently, if a two-component synthetic adhesive system is used, then one of the components should be supplied via the conduit 23 and the other component via the conduit 24. It is understood, of course, that the system (apparatus or arrangement) according to the present invention will also require either conduits or containers for the transport of the cement and water (or other components) to the working site. These are considered to be diagrammatically included in the illustration of the conduits 23, 24 and the cement and water supplies as shown.

It is also understood that the mixing of the components can take place within the respective prop casing 1, 2, rather than in the device D, if one or the other of the two components (e.g. water and cement; gypsum and cement; two-component synthetic plastic adhesive system) is already present in the prop casing 1, 2, before the other component is admitted into the same via the port 11, and that a device different from device D can be used.

It is also possible to provide an apparatus for mechanically telescoping the sections 1, 2 apart to the requisite extent, once they have been placed in upright position, and this apparatus or another apparatus may be utilized to compress the spring 8 in preparation for insertion of the retainers 10. Furthermore, apparatus may be provided for subjecting the prop casing 1, 2 to vibrations in order to compact and densify the flowable substance admitted into it, e.g. the concrete slurry, so as to obtain a denser product which, when hardened, is able to withstand greater stresses.

Figure 6:
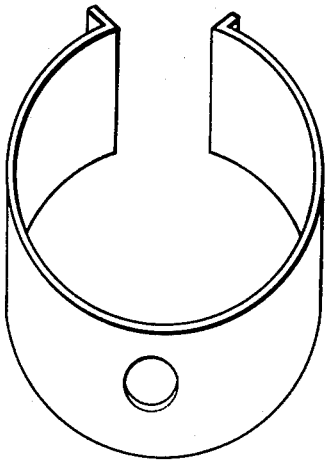
FIG. 6 is a top perspective of an element for use with the device of FIGS. 4 and 5.

The steps involved in filling the prop casing 1, 2 with the hardenable substance will be described with reference to FIGS. 6 and 7, it being understood that FIGS. 7A–7E are respective cross-sections through the prop casing section 2, taken in a plane which passes through the port 11, but with the bars 5, 7 omitted for simplicity.

Figure 7A:
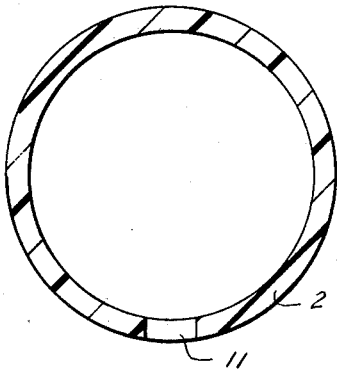
FIGS. 7A–7E are respective cross-sections through an installed prop casing according to the invention, showing the casing before, during and after filling with a hardenable substance.

FIG. 7A is a section through the prop casing after the same is erected at the location where a supporting column is to be produced. The interior of the casing is empty, except for the (not illustrated) reinforcing bars 5, 7 and the possible presence of aggregate or of a component (also not shown) of the hardenable substance.

Figure 7B:
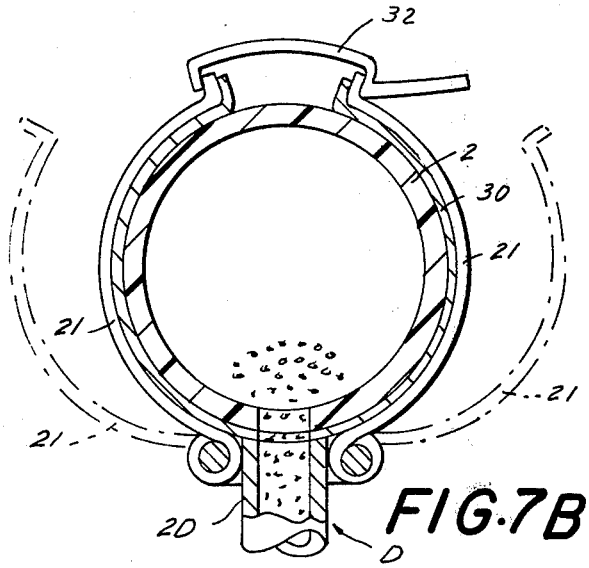
Figure 7E:
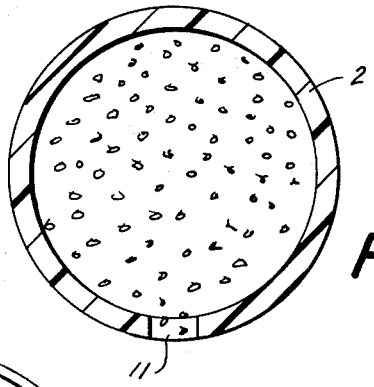

As shown in FIG. 7B, the injecting device D is now placed on the section 2, with its arms in the broken-line position which corresponds to the position of FIG. 5. Before this is done, however, a spring clamp 30 (FIG. 6) having an opening 31 is placed around the section 2 so that its opening 31 registers with the port 11. The arms 21 of the device D are then moved to the closed (solid-line) position shown in FIG. 7B, in which they are held by a retainer 32 (of e.g. steel, such as spring steel, or the like) which engages behind the hook-shaped ends of the arms 21. Evidently, the retainer could also be formed integrally with a free end of one of the arms 21, if desired, and its operation would still be the same. Of course, the outlet opening 21*a* must register with the opening 31 which in turn registers with the port 11, as shown. The operator then depresses the trigger 22 of the device D and the hardenable substances (or one of its components, if the other component is already present in the casing) is now injected through the port 11 until the casing 1, 2 is filled.

As shown in FIG. 1, the section 2 is provided adjacent its inner end with a safety vent opening 12 which is normally located within, and then blocked by, the section 1. Should a worker inadvertently telescope the section 2 out of the section 1 beyond the permissible extent, so that there is no longer a sufficient length of the section 2 in the section 1 to assure the stability of the pit prop casing against separation due to forces acting transversely of or inclined to its longitudinal axis, then this vent opening 12 will become exposed. During the filling operation the hardenable substance will then flow out through the opening as soon as it has risen sufficiently in the section 1. This is a signal to the operator that the pit prop casing cannot be relied upon to resist collapse if it were to be completely filled with the substance; the operator will then discontinue filling and the prop casing will either be reset or be replaced with a different one.

Figure 7C:
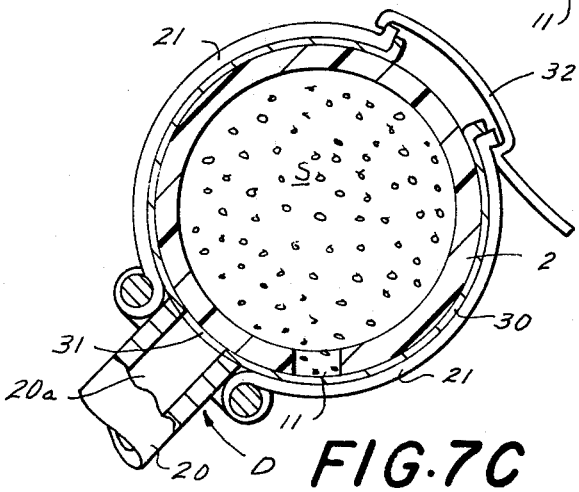
Figure 7D:
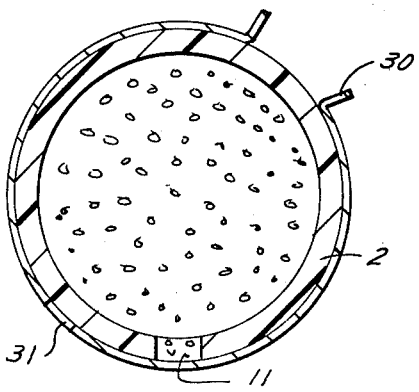

Upon completion of the filling operation shown in FIG. 7B the device D and the clamp 30 are swung about the section 2, until the outlet opening 20*a* and the opening 31 have moved out of registry with the port 11 which is now sealed by a solid (i.e. non-perforated) portion of the wall of clamp 30 (FIG. 7C). The device D can then be removed, leaving behind the clamp 30 (FIG. 7D) which seals the port 11 and is not removed until the hardenable substance S has set, to form within the pit prop casing a solid supporting column or pillar E (FIG. 7E) which supports the overburden. Of course, when the clamp 30 is used, a separate one-way valve to prevent outflow from port 11 is not needed.

In many instances it will be desirable or even necessary to remove the pillar P at a later date. For example, in coal mining this is sometimes done in order to deliberately allow the roof to collapse and fill a gallery after the same is "worked out", i.e. after the accessible coal has been removed. After initial subsidence the caved-in area, called the goaf or gob, supports the overburden and thus reduces the pressure of the overlying strata on e.g. the face supports in a coal mine. As a general rule the pillars will, of course, be under pressure from the overburden at the time they are to be removed. Since they are thus firmly held between the roof and the floor they evidently cannot be simply taken away at will.

To make the removal of the pillars nevertheless possible in a simple, inexpensive and rapid manner, an arrangement may be provided such as the one which is shown in FIG. 8.

This arrangement utilizes an upright hollow cylindrical socket 40, the lower end of which is preferably provided with a base plate 42. The socket 40 must be of a material which is strong enough to support the weight of the pillar P and also to withstand the expected pressures of the overburden, e.g. of steel; plate 42 may be welded to it. The socket is provided with two oppositely located holes 41, 41 into which a wedge 43 (of e.g. steel) is inserted. A supporting plate 44, preferably corresponding in its outline to the interior cross-section of the socket 40, rests on the wedge 43.

The socket 40 is put in position where a pillar P is to be produced. One end of the pit prop casing (usually the lower end of the section 1) is then inserted into it from above, to rest on the plate 44. This is diagrammatically illustrated by a showing of the pillar P. Thereafter, the installation of the pit prop casing and the formation of the pillar P proceeds as described before.

When, at a later time, the pillar P has served its purpose and is to be removed, impacts on the free end 43*a* of the wedge drive the wedge out of the holes 41, whereupon the plate 44 and the pillar P (usually still encased in the pit prop casing 1, 2) drop down onto the plate 42. The upper end of the pillar thus becomes disengaged from the roof and the pillar can then be readily removed; if the roof is to be allowed to collapse, it will suffice simply to topple the pillar P, rather than to take it away. If circumstances permit, the socket 40 and its associated components can at that time be recovered for reuse.

A similar arrangement, but operating on a hydraulic basis, is illustrated in FIG. 9 wherein like reference numerals designate the same elements as in FIG. 8.

However, whereas in FIG. 8 the interior of the socket 40 below the wedge 43 is empty, this same space in FIG. 9 contains a bladder 50 of e.g. elastomeric material (such as natural or synthetic rubber or synthetic plastic material). The openings 41 are omitted, but the wall of socket 40 has a hole 51 in which a valve is installed which communicates with the interior of the bladder 50. A liquid under pressure (e.g. oil or water) is accommodated in the bladder 50, filling the same.

The operating principle is the same as before: the lower end of pit prop section 1 is inserted into the socket 40 to rest on the plate 44. Again, this is symbolically shown by illustration of the pillar P. Prior to the insertion or subsequent thereto but prior to admission of the hardenable substance into the pit prop casing, the bladder 50 is filled with hydraulic fluid (and might even be somewhat stretched), so that it is able to support the weight of the subsequently-to-be-constructed pillar P and also to withstand the pressure exerted by the overburden. The material of bladder 50 must of course be able to withstand the stresses to which it will become exposed.

When, at a later point in time, the pillar P is to be removed, the valve 51 is opened to permit the escape of hydraulic fluid which is pressurized by the weight bearing upon the bladder via plate 44. This results in collapse of the bladder 50 so that plate 44 and pillar P can descend towards base plate 42, thus releasing the pillar P from the pressure of the overburden and permitting it to be removed or to be toppled. Again, the socket and associated components may be recovered for reuse, circumstances permitting.

It will be appreciated that the arrangements of FIGS. 8 and 9 are not limited to use with the inventive pit prop casing and cast-in-situ pillars or props, but could, instead, also be used with conventional prefabricated pit props of e.g. wood, metal or concrete.

When any excavation opening is made underground, the state of stress of the overlying strata, previously in equilibrium, is changed in the vicinity of the opening. To maintain equilibrium, the overburden pressure previously sustained by the extracted portion (where the excavation is made), is transferred onto both sides and the surrounding rocks are deformed. One of the results of this is that the roof of the excavation tends to settle; if not counteracted, a break (cave-in) may occur (Bu Mines, IC 8740, 1977). If, however, the settling is allowed to proceed first to a certain extent and further settling is then counteracted by the roof supports, a new equilibrium state will develop. It is therefore advisable that pit props of any kind have the ability to yield to a limited extent to the very high settling pressures so that they will not become destroyed and can thereafter, when the pressure decreases as a new state of equilibrium is approached, reliably prevent further settling which would lead to roof breaks.

Several embodiments of an arrangement which protects the pit props (pillars or the like) against damage due to overload while allowing limited settling of the roof, are illustrated in FIGS. 10–15. These embodiments are advantageously used with a pit prop casing according to the invention (and with a pillar of hardenable material produced inside the casing); however, they can also be used with conventional prefabricated pit props of metal, steel or other materials.

Figure 10:
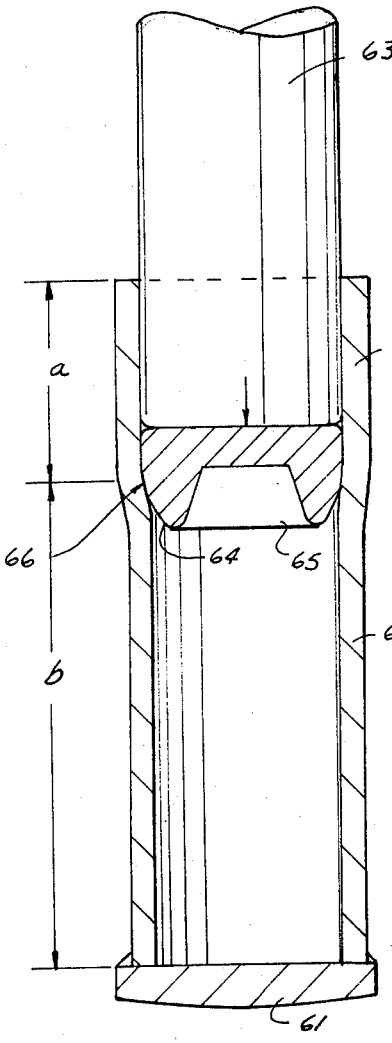
FIG. 10 is a vertical section through one embodiment of a pit prop overload protector.

The arrangement shown in FIG. 10 shows an overload protector having an upright tubular wall 60 of metal (usually steel) to the lower end of which plate 61 is secured by e.g. welding. Of course, in this and in all of the following embodiments the base plate could also be of one piece with the tubular wall. The inner diameter of the tubular wall 60 is greater in the upper zone a as compared to the lower zone b, so that a core 62 may be inserted within the confines of the wall in zone a. The core 62 has the illustrated shape and may be provided in its lower side with a recess 65 to make it lighter in weight (hence easier to handle) and to save material. Due to the rounded configuration of the circumferential edge face 64 of the core, the latter rests on a shoulder 66 which forms the transition from the zone a to the zone b of wall 60.

To use this overload protector, a worker places the overload protector upright on the floor and inserts the lower end of a diagrammatically shown prop casing 63 according to the invention (e.g. the one in FIG. 1) into the upper open end of the wall 60, so that it rests on the flat or substantially flat (e.g. ribbed) upper surface of the core 62. The prop casing is then braced against the roof (not shown) and a pillar of hardened material formed in it, also in the manner described before. Instead of this, however, a prefabricated pit prop of metal, wood or other suitable material could also be used and would be directly inserted into the wall 60 in lieu of the pit prop casing 63.

When settling of the roof occurs, the resulting pressure (see the arrow) acting upon the pit prop (i.e. either on the pillar of hardened material inside the inventive pit prop casing or upon a conventional pit prop used in its place) will drive the pit prop downwardly, causing the core 62 to enter the zone b and, in so doing, to effect plastic deformation of the wall 60. The strength of the material and the thickness of the wall 60 are so selected that this yielding (plastic deformation) will occur before the maximum load-carrying capacity of the pit prop 63 has been reached. This protects the pit prop from damage or destruction and allows a limited settling of the roof, with a view towards the reestablishment of an equilibrium condition at which the pit prop will no longer be subjected to pressures in excess of its capabilities.

Figure 11:
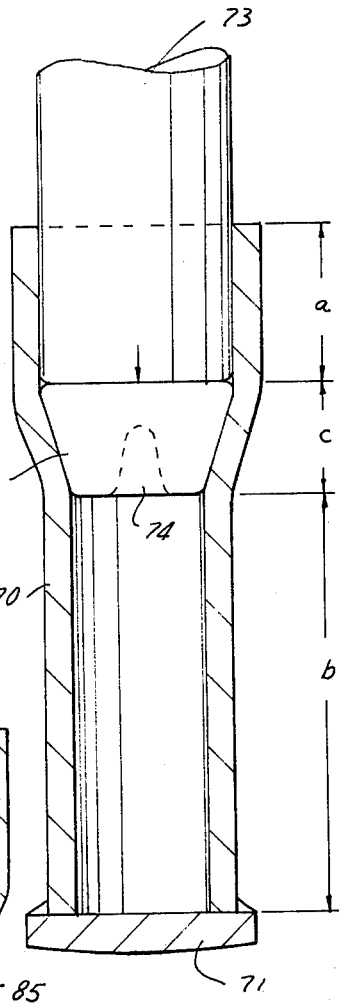
FIG. 11 is a view analogous to FIG. 10 but showing a different embodiment of the overload protector.

In the embodiment of FIG. 11 the upright tubular wall has reference numeral 70 and the base plate is designated 71. Again, the two zones a and b obtain, as before. Here, however, a larger transition zone c connects the zones a and b since the core 72 is of downwardly frustoconical shape. The core may again have a recess, here designated 74 and the pit prop (pit prop casing with pillar or conventional pit prop) is designated with reference numeral 73. The operation of this embodiment is the same as in FIG. 10.

Figure 12:
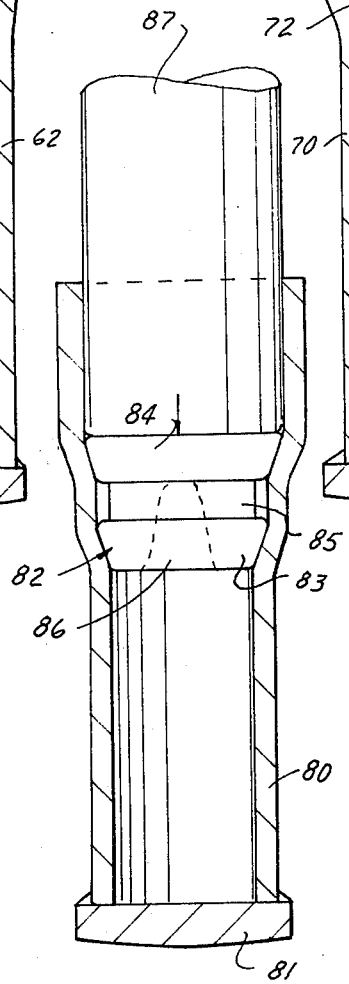
FIG. 12 is a vertical section through an overload protector which is a modification of the one in FIG. 11.

Another embodiment which operates on the same principle as FIGS. 10 and 11 is shown in FIG. 12, where the tubular wall has reference numeral 80 and the base plate reference numeral 81. The pit prop is designated with reference numeral 87.

The core in this embodiment has two axially spaced, downwardly frustoconical portions 83 and 84 which are connected by a reduced-diameter portion 85 of e.g. cylindrical shape. The wall 80 again has different internal diameter zones, as shown, but in this embodiment two shoulders are formed, on each of which one of the portions 83, 84 rests. The core may again be provided with a recess, here designated with reference numeral 86.

In this embodiment the two portions 83, 84 simultaneously effect outward plastic deformation of the wall 80 when the core is driven downwardly. However, due to their different diameters the portion 83 first causes a lesser deformation and, when the portion 84 reaches a wall portion which was already deformed by portion 83, it again causes a further deformation of the same wall portion. The resistance offered by this arrangement to pressure acting upon the pit prop 87 can therefore be greater than that in FIGS. 10 and 11.

Figure 13:
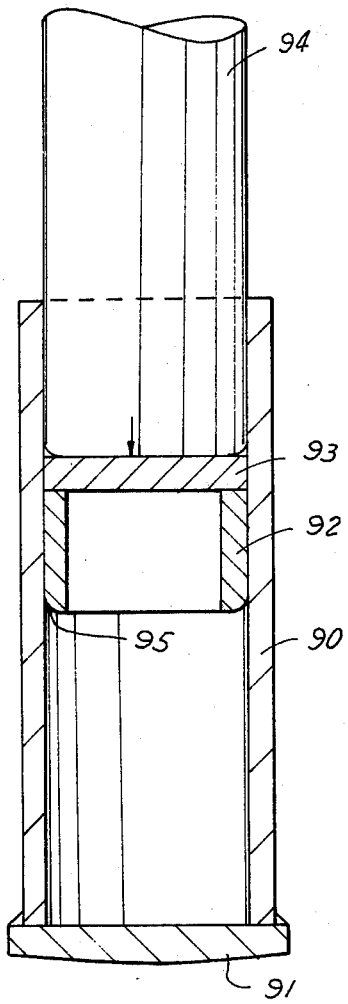
FIG. 13 is a vertical section through an overload protector according to a further embodiment.
Figure 14:
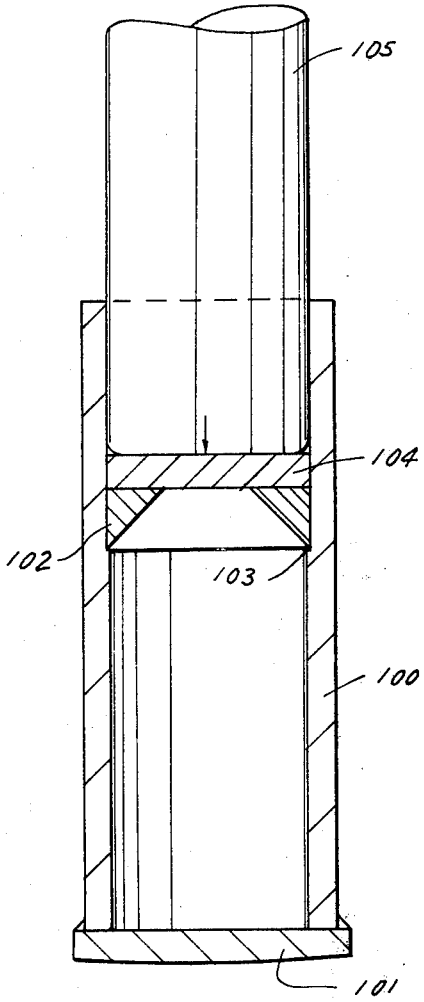
FIG. 14 is a view similar to that in FIG. 13 but showing an overload protector according to still another embodiment.
Figure 15:
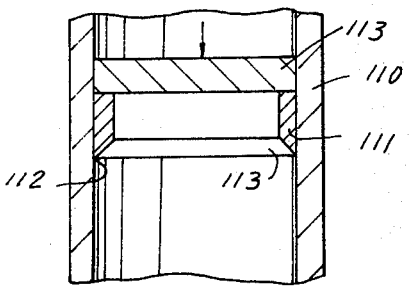
FIG. 15 is a fragmentary vertical section through an embodiment of an overload protector which is a modification of the one shown in FIG. 14.

Finally, three further embodiments of the inventive overload protector are described in FIGS. 13–15; these operate on a different principle than those of FIGS. 10–12.

In FIG. 13 the tubular wall and the base plate have reference numerals 90 and 91, respectively, and the pit prop is designated with reference numeral 94.

Instead of a core, however, a ring 92 (of e.g. steel) having an outer diameter somewhat greater than the inner diameter of the wall 90, is press-fitted into the same. A supporting plate 93 for the pit prop 94 may be placed loosely on top of the ring 92 or may be suitably secured to it, as e.g. by welding. The inner diameter of the wall 90 is here of constant cross-section but could instead have a slight convergence in downward direction. The slightly rounded or bevelled bottom edge 95 of ring 92 facilitates its insertion into the wall.

In this embodiment the yieldable resistance to the downward movement of pit prop 94 under the influence of roof pressure is afforded by the high coefficient of friction between the inner circumferential surface of wall 90 and the outer circumferential surface of the pressfitted ring 92.

FIG. 14 shows an embodiment wherein the wall and the base plate are designated with reference numerals 100, 101 respectively. The pit prop has reference numeral 105.

Again, the core of FIGS. 10–12 is replaced with a ring 102 carrying a pit-prop supporting plate 104. Unlike the ring 92 of FIG. 13, however, the ring 102 has its lower edge shaped as a cutting edge 103. The upper part of the wall 100 has a somewhat larger diameter than the lower part, so that a shoulder exists at their juncture on which the cutting edge rests. In this embodiment the resistance offered by the overload protector to downward movement of the pit prop 105 and the ring 102 under pressure on the former, results from the fact that the cutting edge 103 cuts into the material of the wall 100 as this ring 102 moves downwardly.

The embodiment of FIG. 15 is a modification of the one in FIG. 14. Only a portion of the length of tubular wall 110 is shown; a base plate will be present as in the other embodiments. The pit prop has been omitted for simplicity.

In this embodiment the ring 111, carrying the pit-prop support plate, is of cylindrical shape, unlike the ring 102 of FIG. 14. Ring 111 also has a lower cutting edge 112, produced by bevelling the inner surface of the ring as shown at 113. The operation of this embodiment is the same as in FIG. 14. As in FIG. 14, the wall 110 has a larger upper and a smaller lower inner diameter, so that a step or shoulder is formed on which the cutting edge 112 rests until sufficient pressure on the pit prop causes the edge 112 to cut into the material of wall 110 as the ring 111 yields in downward direction.

From the foregoing it will be understood that the method and system according to the present invention make it possible to erect roof supports quickly, efficiently and at low cost in virtually any location where there is a need for such supports. Furthermore, the invention also enables a user to remove the installed supports even while they are under load (pressure) from the overburden and, in addition the invention provides enclosed protection for the installed supports to keep them from becoming damaged or destroyed.

The present invention is susceptible of a variety of modifications, all of which are intended to be encompassed in the scope of the appended claims. For example, the bladder in the embodiment of FIG. 8 may be reinforced; this can be done by embedding glass fibers or other fibers, or wires or other suitable material, in its wall. The sockets intended to allow removal of the pit prop while the same is under load, or to protect the pit prop against overloading, need not be installed at the lower end of the pit prop or of the pit prop casing, but could also be installed at the upper end, between the same and the roof. A different arrangement than the one shown in FIG. 4 may be used for injecting the hardenable substance into the prop casing. In FIG. 8, two or more of the wedge members could be utilized, or a bifurcated wedge member might be used. The cross-sectional configuration of the pit prop casing in FIG. 1 and of the various sockets in FIGS. 7–15 is shown to be circular but could, of course, be of any other desired shape, for example quadratic, octagonal (or, more generally, polygonal) or elliptical.

The floor in underground excavations is, of course, never very smooth since operating conditions and economic reasons make this impractical. A problem which can be expected to be encountered when the bottom face of a pit prop or of a pit prop casing (or socket for later removal or for overload protection) bears against the rough floor underload, is that the raised parts of the floor will collapse under the pressure. This reduces the load-carrying capacity of the floor drastically (in some instances to one-seventh or one-tenth of the original factor) and allows the pit prop or casing containing the pit prop, to descend so that its upper end recedes from the roof with a concomitant loss of the roof-supporting function.

Figure 16:
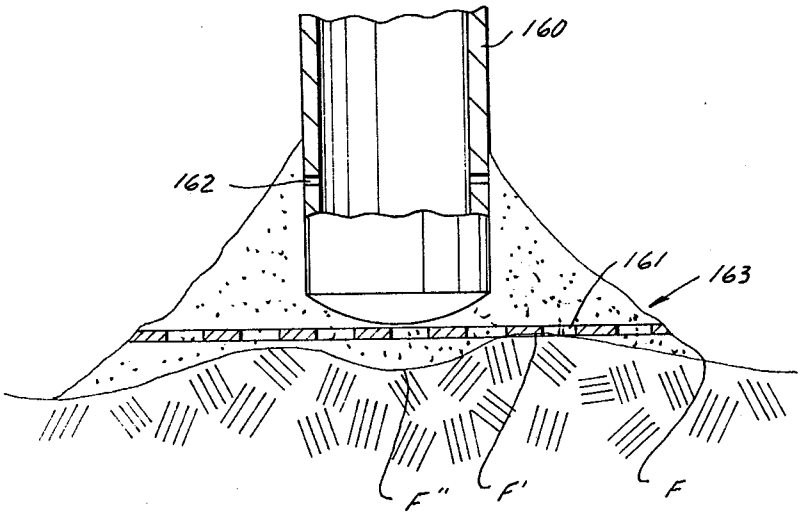
FIG. 16 is a fragmentary vertical section showing still another embodiment of the invention.

To avoid this problem, a further aspect of the invention suggests, as shown in FIG. 16, that prior to installation of the pit prop or pit prop casing 160 a support in form of a wire or steel mesh, plate or the like 161 be placed on the floor F to bridge the raised portions F′ and depressed portions F″ thereof. The pit prop is then produced inside the casing 160 as described before.

Here, however, the lower end of the prop casing is provided with holes 162 through which some of the hardenable mass can flow out, to form a base or foot 163 about the lower end of the casing 160. Since the mass at this time is in flowable state, it will flow beneath the support 163 and fill the depressions F″, creating a solid base whose presence prevents the floor F, or rather the raised portions F′ thereof, against collapse due to being crushed when load acts from the roof on the pit prop. Of course, the holes 162 could be omitted and the injecting device (e.g. the one in FIG. 4) be used to simply spray the hardenable mass around the lower end of casing 160 and beneath the support 161 to create the base 163. A similar procedure may be employed at the top of the prop casing where the same engages the roof (not shown).

It is also possible to have the support 163 (which serves, inter alia, to retain and facilitate bonding of the hardenable mass) extend from one to another of the pip prop casings (e.g. two casings installed at opposite sides of a gallery). In addition to the bases 163 a reinforced connection (e.g. a strip of cement reinforced by the embedded support 161) can then be produced by using the injecting device to spray the hardenable material onto, around and beneath that portion of the support 161 which extends between the adjacent pit prop casings. The same arrangement may also be used to connect the tops of adjacent casings, beneath the roof.

While the invention has been illustrated and described as embodied in arrangements for supporting a roof of an underground excavation, it is not intended to be limited to the details shown, since various modifications and structural changes may be made without departing in any way from the spirit of the present invention.

Without further analysis, the foregoing will so fully reveal the gist of the present invention that others can, by applying caurrent knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of supporting a roof, particularly a roof of an underground excavation such as a mine, comprising the steps of providing a hollow prop casing composed of at least two non-loadbearing telescopable sections, erecting the prop casing and telescoping it apart until it bears upon the floor and upon the roof to be supported; biasing the sections of the prop casing in the telescoped-apart position against the floor and the roof, respectively, so that the prop casing is thereby held in place, but without having any loadbearing function; and only thereafter filling the prop casing with a hardenable substance in flowable condition so that the prop casing acts as a form for the hardenable substance until the latter, upon hardening thereof, forms a solid column which by itself is able to support said roof.

2. A method as defined in claim 1, wherein the step of filling comprises injecting the flowable substance under pressure into the prop casing.

3. A method as defined in claim 1, wherein the step of filling comprises injecting a viscous slurry of quick-hardening concrete into the prop casing.

4. A method as defined in claim 1; and further comprising the step of embedding reinforcements in said substance.

5. A method as defined in claim 4, wherein the step of embedding comprises disposing reinforcing elements within the hollow prop casing prior to the step of erecting the same, so that the reinforcing elements become surrounded by said substance when the prop casing is filled with the same.

6. A method as defined in claim 5, wherein the reinforcing elements are variable in length; and further comprising the step of varying the length of the reinforcing elements in conformity with the telescoping-apart of the prop casing.

7. A method as defined in claim 1, wherein the step of filling comprises forming a slurry from two components which, when mixed, harden to form said column, and admitting the slurry into the prop casing.

8. A method as defined in claim 7, wherein the prop casing has an inlet port and the slurry is admitted into the prop casing under pressure via an injecting device which is releasably connectable to the prop casing to communicate with said inlet port.

9. A method as defined in claim 8, wherein the components are water and cement powder and are fed separately to the injecting device and admixed therein to form the slurry to be admitted.

10. A method as defined in claim 9; and further comprising the step of regulating the rate at which the water and cement powder are fed to the injecting device.

11. A method as defined in claim 1, wherein the step of filling comprises injecting a viscous slurry of quick-hardening concrete into the prop casing; and further comprising the step of vibrating the slurry in the prop casing to compact the slurry.

12. A method as defined in claim 1; further comprising the step of confining between the floor and a lower end of the prop casing a support which maintains the lower end out of contact with the floor but transmits pressure between them; and, when the prop casing and column are later to be removed while being subjected to pressure by the ceiling, removing the support so that the prop casing and column can downwardly recede from the roof.

13. A method as defined in claim 1; and further comprising the step of protecting said column against damage due to roof pressure in excess of its load-supporting capacity, by confining between the floor and a lower end of the column an overload protection device which yields to roof pressure at a pressure level lower than said load-supporting capacity.

14. An arrangement for supporting a roof, particularly a roof of an underground exacavation such as a mine, comprising a hollow prop casing composed of at least two telescopable sections which can be telescoped apart subsequent to erection of the prop casing so as to bear upon the roof and a floor beneath the same, said sections having sufficient strength to be self-supporting but not to support the roof; means for biasing said sections in their telescoped-apart condition against the floor and the roof, respectively, so that the sections are thereby held in position without, however, supporting any load; and means for filling the prop casing with a hardenable substance in flowable condition so that the prop casing acts as a form which contains said substance until the latter, upon hardening thereof, forms a solid column which by itself is able to support said roof.

15. An arrangement as defined in claim 14, wherein said sections are of a light-weight material to facilitate their handling.

16. An arrangement as defined in claim 14, wherein said sections are of synthetic plastic material.

17. An arrangement as defined in claim 14, said filling means further comprising an injecting device having holding members which are engageable with one of said sections so as to releasably retain said injecting device on said prop casing during filling of the same.

18. An arrangement as defined in claim 17, said holding members being arms which are pivotable relative to one another to and from a position in which they embrace said prop casing.

19. An arrangement as defined in claim 18, said one section having a filling port and said injecting device having an outlet which registers with said port during filling of the casing.

20. An arrangement as defined in claim 19; further comprising a circumferentially incomplete spring clamp dimensioned to embrace said one section intermediate the same and said injecting device and having a hole adapted to register with said outlet and said port, said clamp being turnable on and about said one section upon completion of the filling so that said hole moves out of registry with the port and the same is covered by a portion of the clamp to prevent outflow of the injected hardenable substance.

21. An arrangement as defined in claim 17, said injecting device having a trigger which controls the flow of said material from said injecting device to said port.

22. An arrangement as defined in claim 21, said injecting device having at least two inlets; and further comprising conduit means communicating with said inlets for feeding water and quick-hardening cement powder to the respective inlets.

23. An arrangement as defined in claim 21, said injecting device having at least two inlets; and further comprising conduit means communicating with said inlets for feeding water and quick-hardening cement powder to the respective inlets so that the water and cement powder become mixed in said injecting device and form a slurry.

24. An arrangement as defined in claim 21; and further comprising valve means in said conduit means for regulating the flow of water and cement powder through the same.

25. An arrangement as defined in claim 22; and further comprising pump means connected to said conduit means for supplying said cement powder to the same.

26. An arrangement as defined in claim 14, said prop casing having an end portion which is located adjacent to the roof which said prop casing is in erected condition; and further comprising means in said end portion for venting air from said prop casing during filling of the same.

27. An arrangement as defined in claim 14; and further comprising means for reinforcing said substance upon filling of the same into said prop casing.

28. An arrangement as defined in claim 27, said reinforcing means comprising length-variable reinforcing elements located in said prop casing and being variable in length in correspondence with the telescoping of said sections.

29. An arrangement as defined in claim 28, said reinforcing elements comprising a first set of rigidly connected reinforcing rods extending lengthwise in one of said sections, a second set of rigidly connected reinforcing rods extending lengthwise in the other of said sections, and means connecting the reinforcing rods of each set to one another.

30. An arrangement as defined in claim 29, said sections having respective end walls which in use face said roof and said floor, respectively, and each of said sets being connected to the respective end wall.

31. An arrangement as defined in claim 14, said substance comprising two components which, when mixed together, harden to form the solid column in said prop casing; and wherein said filling means comprises an injecting device for injecting at least one of said components into said prop casing.

32. An arrangement as defined in claim 14, said substance comprising two components which, when mixed together, harden to form the solid column in said prop casing; and wherein said filling means comprises an injecting device for injecting a mixture of said components into said prop casing, said injecting device having a pair of inlets for the respective components.

33. An arrangement as defined in claim 14; further comprising overload protection means adjacent a free end of at least one of said sections projecting in part axially beyond the same and being yieldable to pressure acting lengthwise of the prop casing so as to protect the column formed in said prop casing from pressure in excess of its load-bearing capacity.

34. An arrangement as defined in claim 33, wherein said overload protection means further comprise means preselecting the pressure at which yielding is to occur.

35. An arrangement as defined in claim 34, wherein the last-mentioned means comprise a friction-locking device.

36. An arrangement as defined in claim 33, wherein said overload protection means comprises an upright tubular element including a circumferential wall having an upper end in which a lower end portion of the pit prop casing in receivable, and a lower end engageable with the floor, and a core received within said tubular element for supporting said lower end portion from below, said core being dimensioned to yield to pressure transmitted from the roof by shifting toward said lower end under simultaneous plastic deformation of said wall.

37. An arrangement as defined in claim 36, said core having a circumferential edge face which is arcuately rounded in direction from an upper to a lower axial endface of the core.

38. An arrangement as defined in claim 36, said core tapering frustoconically in direction toward said lower end, and said tubular element having an upper portion of a larger inner diameter, a lower portion of a smaller inner diameter, and a shoulder connecting said portions and on which said core is seated prior to shifting toward said lower end.

39. An arrangement as defined in claim 36, said core having two axially spaced parts which taper frustoconically toward said lower end and an intermediate part which connects said axially spaced parts, said tubular element having an upper portion, an intermediate portion and a lower portion of progressively smaller diameter, said intermediate portion merging into said upper and lower portions via respective shoulders on which said axially spaced parts of said core are respectively seated prior to shifting toward said lower end.

40. An arrangement as defined in claim 33, wherein said overload protection means comprise an upright tubular element including a circumferential wall, a friction ring and a support for said prop casing carried by said friction ring, said friction ring having an outer diameter slightly greater than the inner diameter of said tubular element and being press-fitted into the latter and being yieldable to pressure transmitted from the roof by shifting toward a lower end of said tubular element against the constraint of the friction between the contacting external and internal surfaces of said ring and said wall, respectively.

41. An arrangement as defined in claim 33, wherein said overload protection means comprise an upright tubular element having a circumferential wall bounding an interior which has a larger upper inner diameter and a smaller lower inner diameter and a shoulder therebetween, and a ring received in said interior and having a lower cutting edge seated on said shoulder and facing towards a lower end of said tubular element, said ring being yieldable to pressure transmitted from the roof and resisting such yielding by penetration of said cutting edge into the material of said wall.

42. An arrangement as defined in claim 41, wherein said ring has an outer circumferential surface and an inner circumferential surface and a lower end of the ring is provided with a bevel extending from said inner to said outer circumferential surface to form said cutting edge.

43. In an arrangement for supporting a roof, particularly of an underground excavation, with a pit prop which bears upon the roof and the floor of the excavation, a device for removing the pit prop while the same is under pressure, comprising an upright tubular element having a circumferential wall of non-loadbearing sheet material provided with an upper open end dimensioned to receive a bottom end portion of a pit prop, and also having a lower end engageable with the floor, said wall also having at least two oppositely located holes; and a wedge member received in said holes extending across the interior of said element and adapted to support the pit prop, said wedge member having a wider end and also having a narrower end which projects from one of said holes so that on application of an inwardly directed force said wedge member may be expelled from at least said one hole, thereby permitting a pit prop to descend toward said lower end of said tubular element.

44. In an arrangement for supporting a roof, particularly of an underground excavation, with a pit prop which bears upon the roof and the floor of the excavation, a device for removing the pit prop while the same is under pressure, comprising an upright tubular element having a circumferential wall of non-loading sheet material; a slidable support for the lower end of a pit prop received in the interior of said tubular element and subdividing the interior into an upper compartment for accommodating the lower pit prop end, and a lower compartment; an elastically distendable bladder accommodated in said lower compartment; and valve means communicating with the interior of said bladder for filling the same with hydraulic fluid which in use carries said support and a pit prop resting on the same, and for venting hydraulic fluid from said bladder to permit the support and pit prop to descend when the pit prop is to be removed.

45. In an arrangement for supporting a roof, particularly of an underground excavation, with a pit prop which bears upon the roof and the floor of the excavation, a device for protecting the pit prop against roof pressure in excess of its load-bearing capacity, comprising an upright tubular element of non-loadbearing sheet material having a lower end adapted to engage the floor, and an upper open end in which a lower end portion of a pit prop is receivable; and means in said tubular element supporting the pit prop therein and yieldable axially of said element in direction to the floor in response to roof pressures upon the pit prop which are lower than the load-bearing capacity of the same by a preselected extent.

46. A device as defined in claim 45, said tubular element having a larger upper and a smaller lower inner diameter, and said means comprising a core member received in the part of said element having said larger inner diameter and having an outer diameter corresponding to said larger inner diameter, said core member having a part-spherical outer circumferential surface in engagement with an inner surface of said tubular member so as to plastically deform the circumferential wall of said tubular members when yielding in said axial direction, whereby the pressure required to cause such yielding is predetermined by the resistance of said wall to plastic deformation.

47. A device as defined in claim 45, said means comprising a core tapering frustoconically in direction toward said lower end, and said tubular element having an upper portion of a larger inner diameter, a lower portion of a smaller inner diameter, and a shoulder connecting said portions and on which said core is seated prior to shifting toward said lower end.

48. A device as defined in claim 45, said means comprising a core having two axially spaced parts, which taper frustoconically toward said lower end and an intermediate part which connects said axially spaced parts, said tubular element having an upper portion, an intermediate portion and a lower portion of progressively smaller diameter, said intermediate portion merging into said upper and lower portions via respective shoulders on which said axially spaced parts of said core are respectively seated prior to shifting toward said lower end.

49. A device as defined in claim 33, wherein said means comprise a friction ring and a support for said prop casing carried by said friction ring, said friction ring having an outer diameter slightly greater than the inner diameter of said tubular element and being press-fitted into the latter and being yieldable to pressure transmitted from the roof by shifting toward a lower end of said tubular element against the constraint of the friction between the contacting external and internal surfaces of said ring and said wall, respectively.

50. A device as defined in claim 33, wherein said wall bounds an interior which has a larger upper inner diameter and a smaller lower inner diameter and a shoulder therebetween, and a ring received in said interior and having a lower cutting edge seated on said shoulder and facing towards a lower end of said tubular element, said ring being yieldable to pressure transmitted from the roof and resisting such yielding by penetration of said cutting edge into the material of said wall.

51. A device as defined in claim 50, wherein said ring has an outer circumferential surface and an inner circumferential surface, and a lower end of the ring is provided with a bevel extending from said inner to said outer circumferential surface to form said cutting edge.

52. A method as defined in claim 1; and further comprising the steps of placing between the prop casing and the floor an apertured support; and admitting some of said hardenable substance onto said support and about a lower end of the prop casing, so that the substance surrounds said lower end and penetrates through said support to form on hardening a base which reinforces the floor against pressures transmitted to it from the roof via the prop casing.

53. A method as defined in claim 52, wherein the step of admitting comprises providing said lower end with at least one aperture through which some of the hardenable substance filled into the prop casing can flow out onto said support.

54. A method as defined in claim 52, wherein the step of admitting comprises spraying said hardenable substance onto said support and about said lower end.

55. A method as defined in claim 1; and further comprising the step of placing between the prop casing and the roof an apertured support; and admitting some of said hardenable substance onto said support and about an upper end of the prop casing, so that the substance surrounds said upper end and penetrates through said support to form on hardening a reinforcement for the roof in the region of said upper end.

56. A method as defined in claim 1, wherein an additional prop casing is erected, biased and filled at a distance from the first-mentioned one, said prop casing being located at opposite sides of an underground passage; further comprising the steps of placing between said prop casings and at least one of said roof and floor an apertured support which spans the spacing between said casings; and admitting some of said hardenable substance onto said support and also about the ends of said casings which are proximal to said support, so that said substance penetrates said support and, upon hardening, forms a reinforcement extending between and connecting said casings.

* * * * *